US005267941A

United States Patent [19]

Snyders

[11] Patent Number: 5,267,941

[45] **Date of Patent: * Dec. 7, 1993**

[54] MICROFILTERS FOR INFANT INCUBATORS

[76] Inventor: Mark Snyders, 13 Erith Street, Botany, New South Wale 2019, Australia

[ * ] Notice: The portion of the term of this patent subsequent to Nov. 8, 2007 has been disclaimed.

[21] Appl. No.: 906,616

[22] Filed: Jun. 29, 1992

Related U.S. Application Data

[63] Continuation of Ser. No. 610,511, Nov. 8, 1990, Pat. No. 5,125,889.

[30] Foreign Application Priority Data

Dec. 4, 1989 [AU] Australia ..... PJ7686

[51] Int. Cl.[5] ..... A61G 11/00

[52] U.S. Cl. ..... 600/22

[58] Field of Search ..... 600/21-22; 128/205.26, 205.29, 909

[56] References Cited

U.S. PATENT DOCUMENTS

| | | | |
|---|---|---|---|
| 2,633,843 | 4/1953 | Higgs | 600/22 |
| 2,648,327 | 8/1953 | Gibbon | 600/22 |
| 3,333,713 | 8/1967 | Grosholz et al. | 600/22 |
| 3,766,217 | 12/1973 | van Galen et al. | 600/22 |
| 4,328,793 | 5/1982 | Martin | 600/22 |
| 5,125,889 | 6/1992 | Snyders | 600/22 |

*Primary Examiner*—William E. Kamm

*Attorney, Agent, or Firm*—Smith-Hill and Bedell

[57] ABSTRACT

A microfilter (4) for fitting into a filter-box of an infants incubator comprises a pad (22) of non-woven filtering material enclosed in an envelope (21) of water-repellent cohesive and non-woven material which is highly permeable to air and oxygen. The envelope prevents the escape of fibrous particles from the pad and has one side colored differently from the other to reduce the risk of being replaced back-to-front in the filterbox. The envelope may be placed in a similar envelope. It may also have one face of multilayer construction with the layers individually removable so that they can be discarded when dirty.

21 Claims, 3 Drawing Sheets

MICROFILTERS FOR INFANT INCUBATORS

CROSS REFERENCE TO RELATED APPLICATION

This is a continuation of copending application Ser. No. 07/610,511 filed Nov. 8, 1990, now U.S. Pat. No. 5,125,889.

FIELD OF THE INVENTION

This invention relates to incubators for infants and is more specifically concerned with a microfilter for use with an incubator to prevent air-borne foreign bodies from entering it.

STATE OF THE ART

The infant incubator currently in wide use in hospitals comprises a chamber inside a transparent canopy in which the infant is placed, and which is supplied with fresh air at a precisely-controlled temperature and relative humidity. In some cases the air is supplemented with oxygen which may be humidified. The air, with or without supplemental oxygen, is drawn into the incubator by an electrically-driven motor impeller which creates a sub-atmospheric pressure downstream of a filter box. This contains a microfilter which effectively divides the filter box into an upstream compartment and a downstream compartment. The filter prevents potentially harmful micro-organisms and other air-borne pollutants from entering the infant chamber which is maintained at a slightly above-ambient pressure.

The air and any supplemental oxygen supplied to the incubator should flow through the filter at a programmed and adequate rate to prevent the concentration of oxygen in the infant chamber from departing from a desired value, and to avoid a build-up in the concentration of carbon dioxide in the chamber from the infant's exhaled breath. A series of vents in the transparent canopy allow excess air, oxygen and carbon dioxide to be exhausted from the chamber.

The filters used with incubators have a filtering core made from a layered pad of non-woven material which is clamped at its margins between peripheral surfaces extending around the inside of a filter box. This is usually located beneath the chamber and to one side of the incubator. A lid covers the filter box and has openings for enabling ambient air and any supplemental oxygen to enter the filter box. The gas flows through the filter in the box and then into the incubator.

Practical experience has shown that there are some shortcomings with existing filters. It is normal practice to replace and discard them when routine inspections show them to be visibly dirty, or at least after three months use. Incubators should also be dismantled and cleaned after each discharge of an infant, or at least once a week. During cleaning and servicing procedures of the incubator it is common practice to remove the filter from the filter box and to restore it to the box when cleaning of the incubator has finished.

The action of temporarily removing the filter can result in it being replaced in a reversed position with respect to its original position in the filter box. This is easy to do, as both sides of the filter look the same and it is only after the filter has been in use for some time that its outside, facing upstream, is discoloured by dirt and captured air pollutants. The effect of replacing a previously used, contaminated filter in a reversed position in the filter box is to run the risk of releasing the accumulated dust on the face of the filter into the infant chamber when the incubator is next used.

A further effect of manhandling a filter is that small particles of the fibrous filter core or pad can detach themselves during the initial or subsequent placement of the filter in the filter box without this being noticed, and these potential pulmonary irritants can find their way into the infant chamber with the incoming air. To lessen the risk of this occurring, a filter is now available in which the filtering layers are located in a pad between two webs of non-woven, continuously-spun material which extend across the exposed faces of the pad and are trapped at their marginal edges, when the filter is in use, between two opposed surfaces which hold the filter in the filter box. Such an arrangement reduces the risk of particles of the filter pad or core detaching themselves from the downstream face of the filter when in use, irrespective of which way the filter is placed in the filter box. However all edges of the soft and relatively thick filter core are still exposed and the action of compressing the bordering edge of the filter between opposing surfaces of the filter box creates a risk of forcing particles of the filter core loose. These may then pass into the inner compartment of the filter box and the incubator internal air passages.

A second problem encountered with microfilters is that moisture entering the filtering pad can restrict its porosity as the pad is very hygroscopic and can clog easily when moistened with water. This moisture may arise because the temperature of the incoming moisture-saturated gas falls beneath the dewpoint, or because a nebulizer or humidifier upstream of the filter creates moisture droplets. The change in the porosity of the filter causes a change in the 'dwell' time of the gas in the incubator chamber so that its composition changes from the optimum mixture.

OBJECT OF THE INVENTION

An object of this invention is to provide an infant incubator with an improved filter.

SUMMARY OF THE INVENTION

A microfilter for use in an infant incubator comprises a pad of non-woven filter material enclosed in a water-repellent cohesive envelope permeable to air and oxygen. The envelope should be cohesive, that is to say free of loose strands. One way of achieving this is to make it from continuous fibre, for example polypropylene, which is spun-bonded.

ADVANTAGES OF THE INVENTION

The microfilter of the invention, being water-repellent or hydrophobic will not allow the entry past it of water droplets so that clogging of the hygroscopic pad or layer filter with water is avoided. Also, the envelope totally encloses the filtering pad so that particles of the filter core detaching themselves from the peripheral edges of the filter during its re-location in the filter box, or from the faces of the filter, remain trapped in the envelope and cannot find their way into the air path leading into the incubator.

Preferably the two exposed faces of the envelope have different colours so that it is immediately apparent if the filter is inadvertently located back-to front in the filter box.

Suitably two or more envelopes are provided, one within the other. When the outer envelope becomes dirty, it may be discarded and the filter can continue to be used as the filter core is still contained within the now-exposed inner envelope. In a variation of such an arrangement the envelope is provided with a multilayer face on its side intended to be upstream. The layers of the side are individually removable as they get dirty. Such an arrangement also acts to extend the useful life of the filter.

INTRODUCTION TO THE DRAWINGS

The invention will now be described in more detail, by way of example, with reference to the accompanying drawings, in which:

IN THE DRAWINGS

DESCRIPTION OF PREFERRED EMBODIMENT

Figure 1:
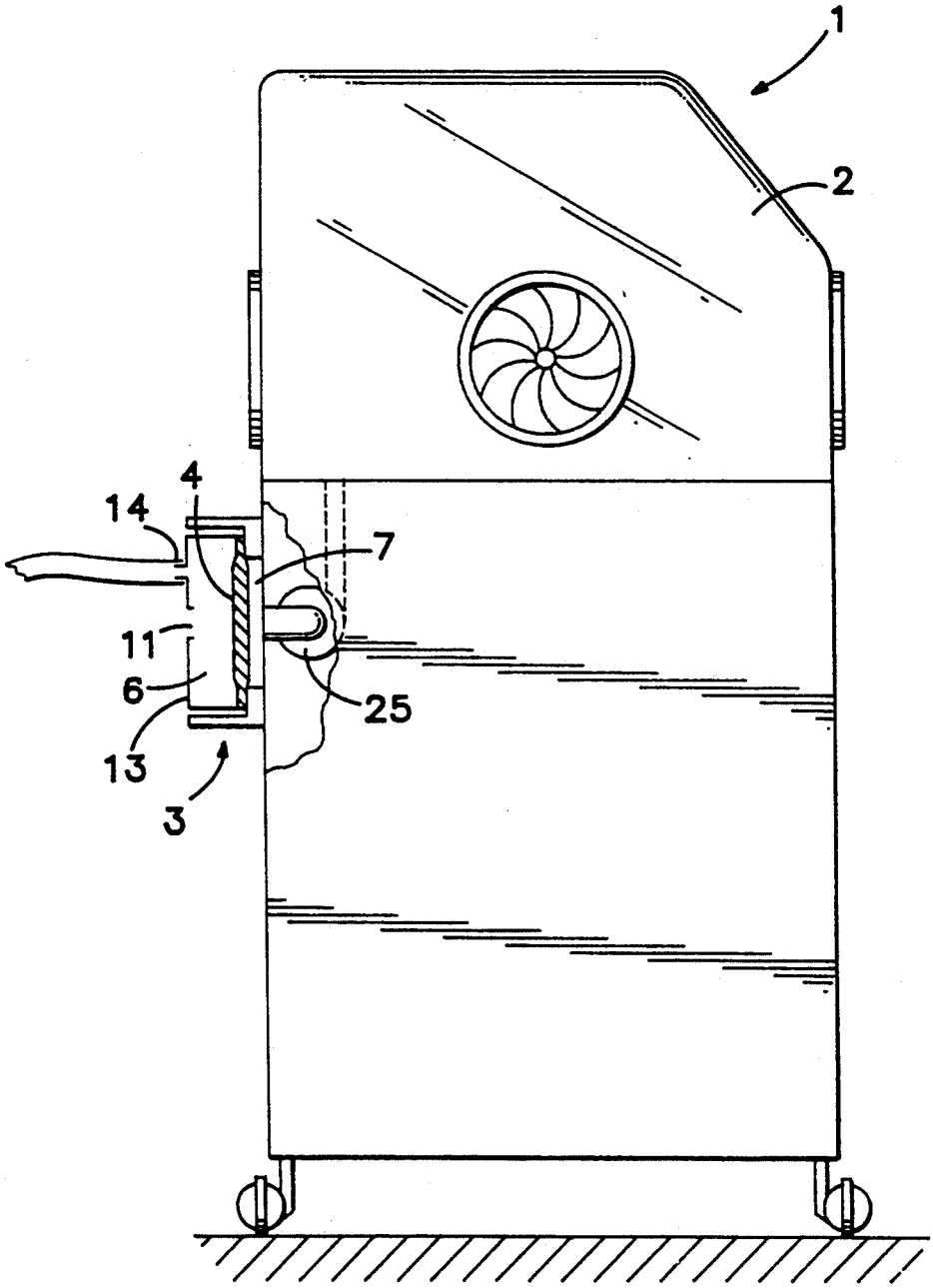
FIG. 1 is a block diagram of a gas circuit to an infant incubator.

The block diagram of FIG. 1 shows an incubator 1 having an infant chamber covered by a transparent canopy 2. The incubator has on one side a filter box 3 containing a microfilter 4 which spans across the interior of he box and divides it internally into upstream and downstream compartments 6 and 7, respectively. Ambient air is admitted to the upstream compartment through a gate 11 in a lid 13 to the filter box, as shown in more detail in FIG. 3. An electrically driven impeller 25, arranged upstream of the infant chamber but downstream of the filter box, maintains a sub-atmospheric pressure in the downstream compartment of the filter box and a slightly above-atmospheric pressure in the infant chamber of the incubator.

If supplementary oxygen is required for the infant, it is supplied through a flexible oxygen tube fitted to a nipple 14 in the filter box lid 13. The oxygen is pressurised and may come from a hospital source; either from a central piping system having an oxygen flow meter and possibly a humidier or a nebulizer adjacent its outlet nozzle, or from a compressed gas cylinder fitted at its outlet end with a pressure reduction regulator and flowmeter and also possibly a humidifier or nebulizer. Both means of providing oxygen are well-known in the art and will not be further described as they form no part of the applicant's invention.

Figure 2:
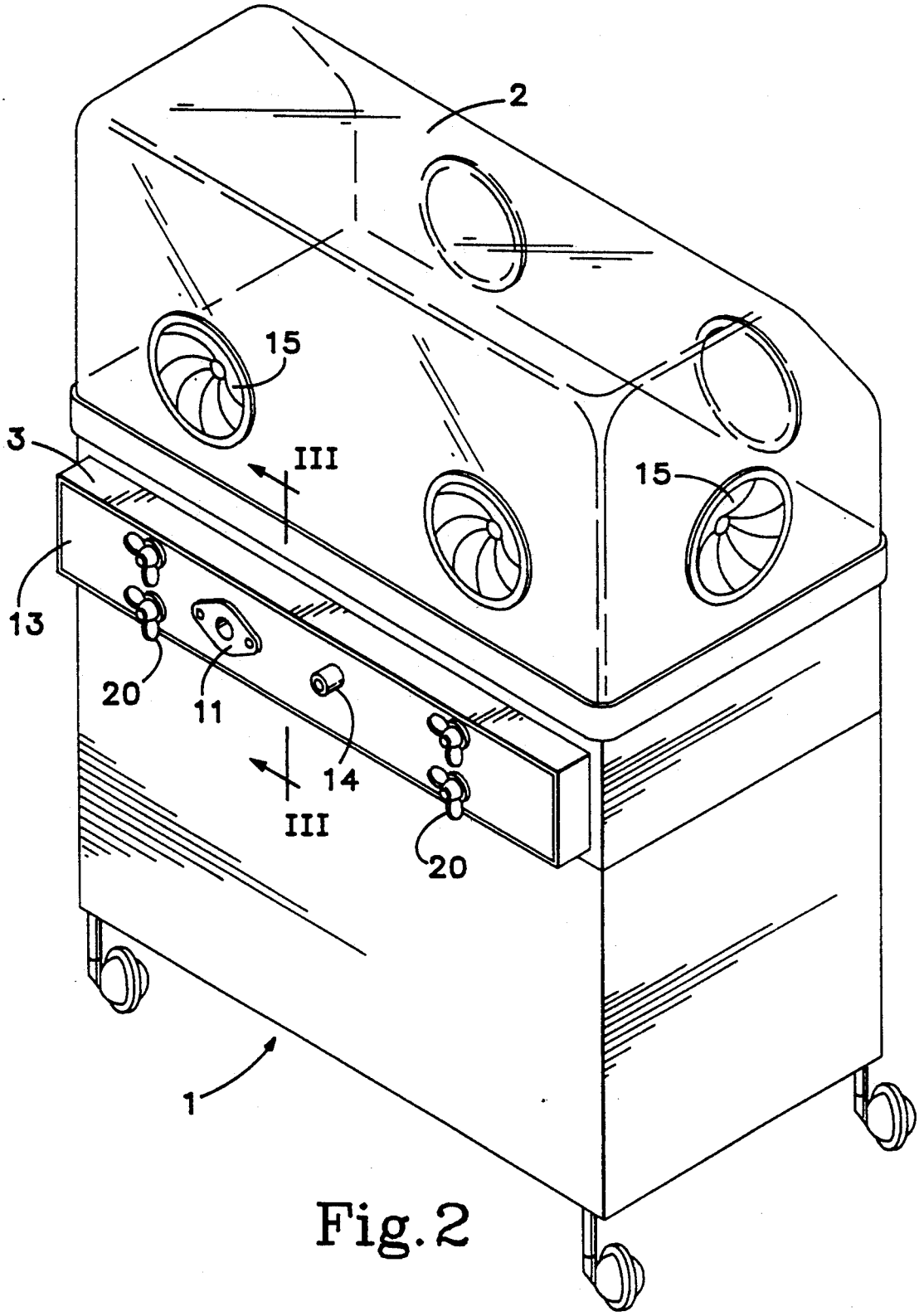
FIG. 2 is a perspective view of the incubator.

The general shape of the incubator is shown in FIG. 2. The transparent canopy enclosing the infant chamber is provided with vents 15 from which the interior of the chamber vents to atmosphere. The canopy is vertically removable from the remainder of the incubator which has the filter box 3 extending along one side.

Figure 3:
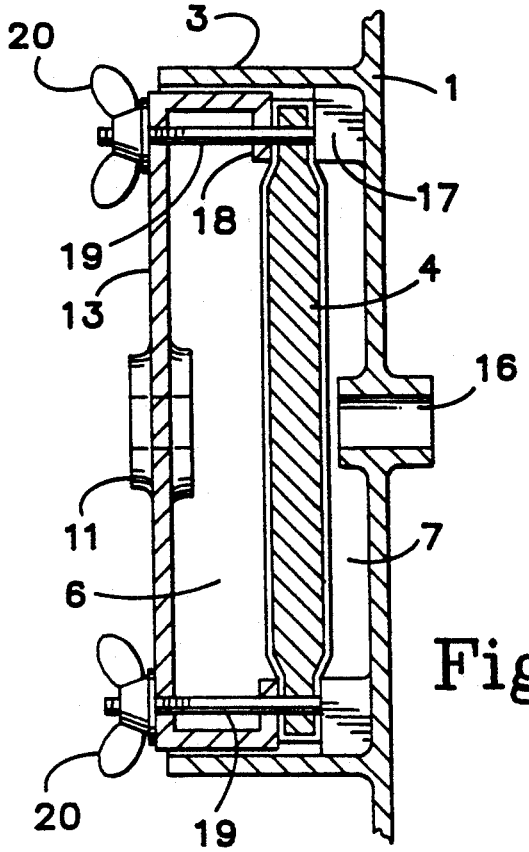
FIG. 3 is a vertical section taken through a filter box used on the incubator, as seen along the line and in the direction of the arrows III—III in FIG. 2; and, FIG. 4 is a cross section, partially broken away, and to an enlarged scale, of a microfilter used in the filter box.

FIG. 3 shows the interior of the filter box 3 and lid 13 in more detail. The filter box 3 is of parallelepiped shape and it is internally divided by the removable filter 4 into the two compartments as shown. The downstream compartment, for the filtered gas, is provided with an outlet leading into the infant chamber. The upstream compartment is formed inside the lid 13. The lid 13 has a peripheral skirt flange terminating in an inwardly directed clamping flange 18.

The wall of the filter box 3 is provided with an internally-directed step 17 extending parallel to the flange 18 of the lid 13. Two pairs of stud bolts 19 are attached to the step 17 and pass through holes at opposite end-portions of the lid 13 and flange 18, and winged nuts 20 are screwed onto the stud bolts 19 to secure the lid 13 to the filter box 3.

The microfilter 4 is clamped at its marginal edge between the parallel faces of the step 17 and flange 18 by the action of tightening the winged nuts 20.

Figure 4:
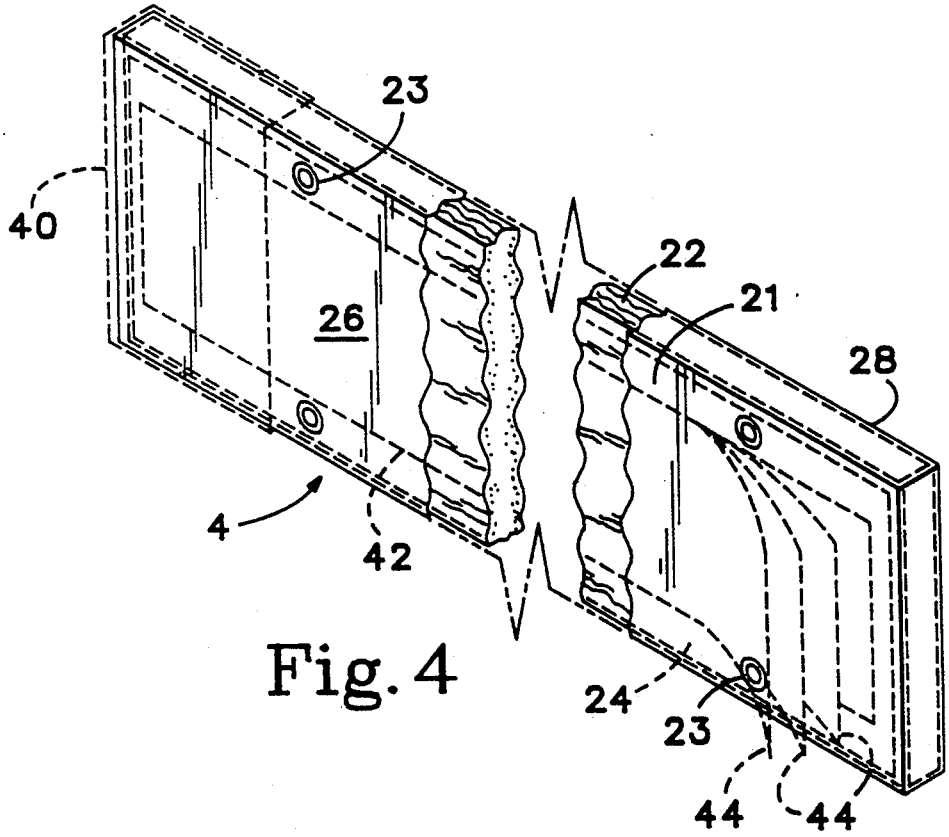

The construction of the microfilter is shown in detail in FIG. 4. It has a filtering core or pad 22 formed from superimposed layers of conventional non-woven microfilter material such as that available from James River Corporation of South Carolina in the United States of America. The pad 22 is contained within a water-repellent or hydrophobic envelope 21 made from a continuous fibre, spun bonded, web of non-woven polypropylene such as that marketed by the Nan Ya Plastics Corporation of Taipei Taiwan R.O.C. under the trade mark "MELTEX". The pad 22 is held in place in the envelope 21 by a rectangular line of stitching 24. In some circumstances it may unnecessary to use special means, such as stitching, to hold the pad in position in the envelope. Alternatively, heat welding a line between the two faces of the envelope may be used in place of the line of stitches 24. Two pairs of holes 23 closed by metal eyelets 23 or other means, allow the filter 4 to be inserted into the filter box 3 by threading the eyelets 23 over the stud bolts 19. The lid 13 is then secured into position by tightening the winged nuts 20 so that the marginal edge of the filter 4 is tightly clamped between the parallel flanges 17 and 18.

One side of the filter envelope 21 is coloured white and the other side is coloured light yellow. A notice on the filter warns the user always to place the white side upstream and not to reverse it.

OPERATION OF THE INVENTION

During cleaning of the incubator, the winged nuts 20 are released and the lid 13 is removed from the box 3 to give access to the filter 4 which is removed from the stud bolts 19. On completion of the cleaning, the filter 4 is replaced, yellow side against the incubator, and the lid secured in place by tightening the nuts 20.

During the manhandling of the filter 4, the envelope 21 retains any fibrous particles which may have detached themselves from the filter pad 22, inside the envelope so that they cannot enter the gas path leading into the incubator. The colouring of the sides of the filter 4 reduces the risk of it being inadvertently replaced back-to-front in the filter box. In this way contaminating matter deposited on one side of the filter is prevented from entering the filtered gas compartment of the filter box and thus the infant chamber.

During operation of the incubator when administering supplemental humidified oxygen for long and medium term therapy, it is not uncommon for moisture droplets to be carried by the gas stream into the filter box. The pad material of the filter 4 is hygroscopic, and its effectiveness is seriously impaired if it becomes clogged with water. This reduces the gas flow through it as well as possibly varying the composition of the incoming gas, if it is a mixture of ambient air and oxygen. However, by enclosing the pad material in a gas-permeable, water-repellent envelope, incoming moisture droplets are deposited onto the outside surface of the envelope and are thus prevented from coming into contact with, and clogging the pad material. Thus the uniformity of operation of the filter 4 can be assured despite the presence of an upstream humidifier or nebulizer.

MODIFICATIONS OF PREFERRED EMBODIMENT

The envelope may comprise two or more envelopes arranged on inside the other. When the outer envelope 40 becomes dirty, it can be discarded and the microfilter can continue to be used as the filter pad is still enclosed in the inner, clean envelope 21 which now forms the outside of the filter.

In a variation of the above embodiment, a single envelope is used to enclose the filter pad or core, and the face of the envelope which is intended to face upstream, is of multilayer construction and provided with 'tearaway' perforations which enable each of its layers 44 to be stripped off the envelope, when it becomes dirty to leave a clean layer exposed beneath it. With this construction of envelope the layers of the face 26 which is to lie upstream are kept white while the downstream face 28 of the envelope is given a distinctive colouring. The layers may also have legend printed on them to instruct the user to always have it facing upstream. Further legend on the innermost layer can indicate to the user that it is the innermost layer which is now exposed.

Each of the above modifications has the advantage of prolonging the life of the filter and avoiding excessive deposits of captured dust and air-borne pollutants from collecting and restricting, or partially restricting essential programmed air/oxygen flows entering the incubator.

Although the arrangement illustrated shows two pairs of stud bolts 19 used to hold the microfilter in place, it is normal practice to use one pair of stud bolts respectively disposed at the centre of opposite end portions of the microfilter.

I claim:

1. A microfilter for installation in an infant incubator for preventing air-borne pollutants from entering an infant chamber of the incubator, said microfilter comprising a filter pad having an upstream side and a downstream side and a water-repellent web attached to and covering the filter pad at the upstream side thereof, said web being highly permeable to air and oxygen, and wherein the web is of multilayer construction, the individual layers of the web being separately removable to expose the layer beneath.

2. An incubator according to claim 1, wherein the web is made of synthetic polymer fiber material.

3. An incubator according to claim 2, wherein the synthetic polymer fiber material is polypropylene.

4. An incubator according to claim 1, wherein the filter further comprises a second web covering the downstream side of the filter pad, said second web being cohesive and highly permeable to air and oxygen.

5. A microfilter for installation in an infant incubator for preventing air-borne pollutants from entering an infant chamber of the incubator, said microfilter comprising a filter pad having an upstream side and a downstream side and a water-repellent web attached to and covering the filter pad at the upstream side thereof, said web being highly permeable to air and oxygen, and further comprising a second web attached to and covering the filter pad at the downstream side thereof, the second web being cohesive and highly permeable to air and oxygen and being colored distinctively relative to the web on the upstream side of the filter pad.

6. An incubator according to claim 5, in which the synthetic polymer material is a polypropylene filament material.

7. An incubator according to claim 4, wherein the web on the upstream side of the filter pad and the second web are mutually attached about the periphery of the filter pad.

8. An incubator according to claim 4, wherein the web on the upstream side of the filter pad and the second web form an envelope that surrounds the filter pad.

9. An incubator comprising wall means defining a chamber, said wall means including gas outlet vents from said chamber, a filter box, a microfilter removably mounted in said filter box and dividing the filter box into a gas inlet compartment and a gas outlet compartment, the filter box having a gas inlet through which unfiltered gas can enter said gas inlet compartment and a gas outlet through which filtered gas can leave said gas outlet compartment, and means for delivering gas from the gas outlet to said chamber, and wherein said microfilter comprises a filter pad, an inner envelope enclosing said pad, and an outer envelope enclosing both said pad and said inner envelope, and wherein each envelope is formed from a water-repellent non-woven cohesive material that is highly permeable to air and oxygen.

10. A microfilter for installation in an infant incubator for preventing air-borne pollutants from entering an infant chamber of the incubator, said microfilter comprising a filter pad having an upstream side and a downstream side and a water-repellent web attached to and covering the filter pad at the upstream side thereof, said web being highly permeable to air and oxygen.

11. A microfilter according to claim 10, wherein the web is made of synthetic polymer fiber material.

12. A microfilter according to claim 11, wherein the synthetic polymer fiber material is polypropylene.

13. A microfilter according to claim 10, wherein the web is of multilayer construction, the individual layers of the web being separately removable to expose the layer beneath.

14. A microfilter according to claim 13, in which each layer of the web is marked with a legend indicating that it is to be placed upstream of the downstream side of the microfilter, and the innermost layer of the web is, in addition, marked with a legend indicating that it is the innermost layer.

15. A microfilter according to claim 10, further comprising a second web attached to and covering the filter pad at the downstream side thereof, the second web being cohesive and highly permeable to air and oxygen.

16. A microfilter according to claim 15, wherein the second web is made from a continuous fiber spunbonded synthetic polymer material.

17. A microfilter according to claim 16, in which the synthetic polymer material is a polypropylene filament material.

18. A microfilter according to claim 15, wherein the second web is colored distinctively relative to the web on the upstream side of the filter pad.

19. A microfilter according to claim 15, wherein the web on the upstream side of the filter pad and the second web are mutually attached about the periphery of the filter pad.

20. A microfilter according to claim 15, wherein the web on the upstream side of the filter pad and the second web form an envelope that surrounds the filter pad.

21. A microfilter according to claim 15, further comprising a water-repellent envelope enclosing said filter pad and said webs, said envelope being highly permeable to air and oxygen.

* * * * *